US005762163A

United States Patent [19]

Kain

[11] Patent Number: 5,762,163

[45] Date of Patent: Jun. 9, 1998

[54] STEP STOOL

[75] Inventor: James M. Kain, Tipp City, Ohio

[73] Assignee: Cosco, Inc., Columbus, Ind.

[21] Appl. No.: 701,491

[22] Filed: Aug. 22, 1996

Related U.S. Application Data

[60] Provisional application No. 60/002,903, Aug. 29, 1995.

[51] Int. Cl.[6] ..... E06C 1/00

[52] U.S. Cl. ..... 182/161; 182/162; 182/180.1

[58] Field of Search ..... 182/116, 125, 182/126, 156, 159, 161, 162, 180.1

[56] References Cited

U.S. PATENT DOCUMENTS

| | | | |
|---|---|---|---|
| 524,661 | 8/1894 | Austin | 182/156 |
| 579,328 | 3/1897 | McConnell | 182/161 X |
| 2,207,923 | 7/1940 | Kelso | 182/156 |
| 2,280,691 | 4/1942 | Edelmann | 182/161 |
| 2,596,521 | 5/1952 | Bell | 182/156 |
| 2,857,087 | 10/1958 | Pratt | 182/156 |
| 2,975,856 | 3/1961 | Anderson et al. | 182/161 |
| 3,127,953 | 4/1964 | Shore | 182/156 X |
| 3,303,906 | 2/1967 | Bouwmeester et al. | 182/161 |
| 4,485,892 | 12/1984 | Maloney et al. . | |
| 4,842,331 | 6/1989 | Waples . | |
| 5,064,243 | 11/1991 | Quain | 182/156 X |
| 5,238,292 | 8/1993 | Golenz et al. . | |

*Primary Examiner*—Alvin C. Chin-Shue
*Assistant Examiner*—Richard M. Smith
*Attorney, Agent, or Firm*—Barnes & Thornburg

[57] ABSTRACT

The invention relates to platform step stools wherein a top step of the stool is movable from its top position to a position in alignment with the step below it to provide for a wider platform than a single step and in particular, to a particular single handle actuated locking mechanism for securing the top step both in its top and alignment height positions.

27 Claims, 5 Drawing Sheets

STEP STOOL

This application claims the benefit of U.S. Provisional Application No. 60/002,903, filed Aug. 29, 1995, pursuant to 35 U.S.C.119(e).

BACKGROUND AND SUMMARY OF THE INVENTION

The present invention relates to a step stool having a top step that is movable from an elevated position above an underlying step to a platform position alongside the underlying step to provide for a wider platform than a single step. More particularly, the present invention relates to apparatus for locking and unlocking the top step to and from a frame so that it is movable between its elevated position and its platform position.

A platform step stool which has a top step movable relative to a frame to a position alongside a next lower step to form a platform is known. See, for example, U.S. Pat. No. 4,485,892 to Maloney et. al. Such a platform step stool includes a pair of latch assemblies which are coupled to the top step and which can be operated to fix the top step to the frame in its upper and lower position. What is desired is a mechanism that can be easily operated with one hand and that will simultaneously disengage both latch assemblies from their locked positions at the same time to allow a user to change the position of the top step in a trouble-free manner.

A platform step stool in accordance with the present invention includes a one-hand release mechanism mounted on a step and coupled to a step-locking mechanism mounted on the step and arranged to engage and disengage a frame supporting the step. The one-hand release mechanism includes a release handle mounted on the step in a centrally located position that is accessible to a user desiring to move the step relative to the frame from an elevated position above an underlying step to a platform position alongside the underlying step.

In use, a user pulls on the release handle to move the release handle relative to the step. This causes two release levers that are attached to the release handle to move relative to the step and pull on or activate spring-loaded locking arms or pins engaging the frame of the step stool to release the step for movement relative to the frame between its elevated position and its platform position.

Rear legs of the frame are formed to include holes for receiving and accepting the spring-loaded locking pins to establish a locked connection between the movable step and the frame. There is an upper set of holes formed in the rear legs to establish the elevated position of the movable step and a lower set of holes formed in the rear legs to establish the platform position of the movable step. The spring-loaded locking arms or pins snap into place in these rear leg holes when the user pulls the movable step into the desired elevated or platform position. A platform step stool in accordance with the present invention uses few parts, is economical to manufacture, and is easy for consumers to use. A user need only use one hand to operate the one-hand release mechanism so as to release the movable step for movement relative to the frame.

The platform step stool in accordance with the present invention is a multi-step (e.g., three-step) step stool that is collapsible for storage. The top step pivots relative to the frame on four arms and hinges in a downward position to form a platform with the underlying second step. The steps are made of injection-molded polypropylene. The front and rear legs are made up of two different length metal U-tubes of one inch diameter. There are four plastic feet attached to bent corners of the U-tubes, and they are fastened together at the top at a left point and a right point by two plastic caps, one per side. The front and back U-tubes hinge off these top caps.

Platform step stools providing for movement of a top step to a position in alignment with a lower step to provide a deeper platform area are known. See U.S. Pat. No. 4,485,892 issued Dec. 4, 1984 to Maloney et al., the details of which are expressly incorporated by reference into this disclosure. In that Maloney patent, a top step 24 is connected to an intermediate step 22 through a parallelogram linkage 44, 48. The intermediate step has its forward end pivoted to a front leg 16 of a collapsible frame assembly 14 and its rearward end pivoted to link 32 pivotally connected to the rear end of the bottom step 20. A step link 34 has its end pivotally connected to the intermediate step and to the rear leg 18 of the frame assembly 14. The top step has a locking assembly 46 along each side. Each locking assembly has a J-shaped bolt 46 which is spring loaded to have its short end insertable into a plurality of apertures 64 in brackets 52 located on the rear legs 18 of the frame assembly 14. The stool is also configured to be collapsed with the top step in a flat vertical position and the front and back legs of the frame assembly abutting one another (See FIG. 8 and the dotted arrangement in FIG. 7).

The instant invention provides for an improved construction over the latching mechanism of that Maloney et al. patent.

The instant invention provides for a single, one-hand release handle, situated in the middle of and underneath the top step, to withdraw a plurality of spring biased locking pins that enter into ports located in this rear legs of the frame assembly supporting the steps whereas Maloney has separate actuators for his "J-Hooks". Thus, a single hand can operate the locking system as opposed to the multi-hand dual locking system in the Maloney patent.

The instant invention also provides for the legs of the frame member to be made from cylindrical tubing bent into a U-shape, a less costly component than the rectangular bar stock disclosed in the Maloney patent.

Additionally, the one-handed pull handle assembly is easily held to the top step assembly by four bolts passing through a plastic containment cap and into screw holes created in the plastic step. This allows for ease in operation, assembly and disassembly (if necessary for repairs) and eliminates much of the spot welding requirements for the location and securement of the locking mechanism in the Maloney patent.

It is an advantage that the locking pins of the instant invention are spring biased to slide through an aperture in an end wall of the top step when the apertures are aligned with the openings in the rear leg of the frame assembly. This simplified structure eliminates the creating and welding of a latch pin housing on a front bar of the parallelogram linkage shown in the Maloney patent as well as eliminates the different orientation assemblages on the frame member to receive the locking pins, due to the fact that in Maloney, the locking pin axis changes as the parallelogram linkage moves from one position to another. In the instant invention, the rear leg of the frame member merely is provided with two ports to receive the locking pins. The simplified mounting of the instant invention leads to a lesser chance of locking bolt misalignment or locking-up of the involved linkages and locking pin structure than that provided by the Maloney patent.

In the instant invention, the single-hand actuated handle is connected to actuate the locking pins through a lever system which allows for a force multiplier effect not possible in the Maloney device. Additionally, the finger pull area of the handle can be made large enough to have four fingers grasp the pull with the heal of the operator's hand positioned against the step. Thus, the actuating motion is merely closing the fingers of the hand while the heal of the hand holds the stool. In the Maloney patent, the loop for the "J-hook" is not large so that at most, one or two fingers can fit therein, thus limiting the force to be applied. The operator must pull on the "J-hook". There is no closing of the hand application since no fulcrum is provided. The operator's second hand must provide the reactive force (fulcrum) to withdraw the "J-hook" in the Maloney device. Also, in Maloney, location and direction of force for the operator's second hand is changed dependent on the height location of the movable top step. The instant invention avoids a fulcrum requirement, avoids a two-handled operation and merely requires a simple hand fist closing actuation and at the same location on the stool, regardless of step position. There is no necessity to pull upward to release the top step at its upper position and horizontally in the top step platform position as required by the Maloney patent.

The one-handed release handle of the invention is located on the bottom side of the top step to allow a user to release two 5/16" diameter elongated steel locking pins by grasping the handle with the fingers and placing the heal of the hand against the step. Alternatively, one can just pull on the handle if the stool is otherwise held. These pins are attached to the bottom of the top step and slide left and right in a horizontal motion during movement of the release handle relative to the top step and are spring-loaded to slide automatically into positioning holes formed in the rear legs and hold their position in a locking mode until the user pulls in a forwardly fashion on the release handle. This motion pulls the two locking pins inward toward one another and a middle portion of the top step, thus allowing for the top step to change position from its elevated position above an underlying second step to its platform position alongside the second step. The user also needs to pull on the spring-loaded release handle to collapse the unit for flat fold storage.

Using cylindrical tubes bent into a "U-shape" to provide the upright legs, one front leg U-tube and one rear leg U-tube, allows for simple, rigid frame members that are easily manufactured without welding. The plastic steps have all required structural strength and rigidity molded into them with no secondary steel reinforcements. The release handle and spring-loaded locking pins cooperate to form an assembly which is easily slid into place on the underside of the top step and held there by a plastic release handle guide and containment cap during manufacture of a step stool in accordance with the present invention. There are very few parts to this assembly and the containment cap is screwed in place on the top step with four fasteners. Minimal parts and ease of assembly hold down labor costs associated with manufacture.

Since the spring-loaded locking pins slide into holes formed in the tubular upright frame members automatically, there is no need to have secondary locking pins. This simplifies the use of the product by the consumer since the assembly works to lock the unit in an opened position (i.e., elevated or platform position) automatically. A step stool including improved apparatus for locking and unlocking a movable top step by means of a spring-loaded release handle and frame-locking mechanism is disclosed herein.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
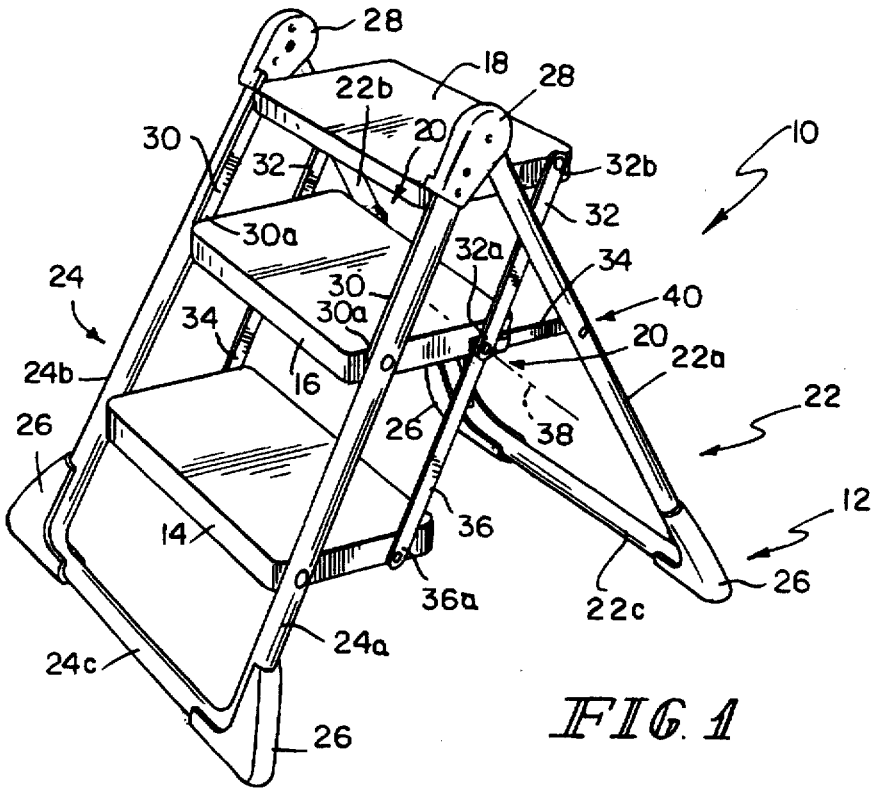
FIG. 1 is a perspective view of the stool showing the movable step in its upper-most position.

A step stool 10 including a frame 12, a first step 14, a second step 16, and a movable top step 18 is, shown in FIG. 1. In other embodiments (not shown), step stool 10 could include more steps like step 14 positioned to lie underneath step 14 and coupled to frame 12. Step tool 10 also includes a linkage 20 for controlling folding of steps 14, 16, and 18 relative to frame 12 and controlling folding of step 18 from an elevated position above step 16 as shown in FIG. 1 to a platform position alongside step 16 as shown, for example, in FIG. 2.

Frame 12 includes a rear circular U-shaped tube 22 providing two rear or first set of legs **22*a*, 22*b* and a base 22*c* therebetween and a front circular U-shaped tube 24 providing two front or second set of legs 24*a*, 24*b* and a base 24*c* therebetween. Two plastic feet 26 are mounted at elbow portions of rear circular U-shaped tube 22 and two plastic feet 26 are mounted at elbow portions of front U-tube 24 as shown in FIG. 1. A pair of pivot brackets 28 are provided at an upper end of step stool 10 for joining free ends of rear and front circular U-shaped tubes 22, 24 together as shown in FIG. 1 to allow for pivoting of front U-tube 24 relative to rear U-tube 22 during unfolding and collapsing of step stool 10. These pivot brackets 28 are arranged in spaced-apart relation so that the movable top step 18 is positioned to lie therebetween once it is raised to its elevated position as shown in FIG. 1**.

Figure 2:
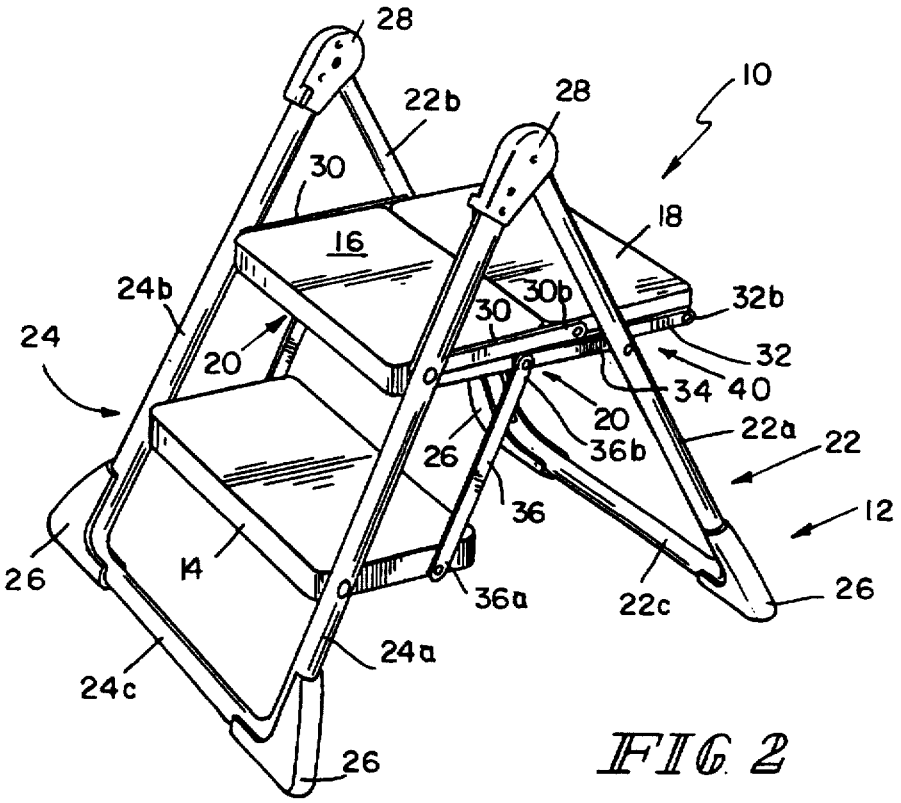
FIG. 2 is a perspective view of the stool showing the movable step-in its lower aligned platform position.

One multi-part linkage 20 is provided on each side of step stool 10 as shown in FIG. 1 to control location and movement of steps 14, 16, and 18 relative to frame 12. Each linkage 20 includes four links. As shown in FIG. 1, a first link 30 is pivotally coupled at a lower end 30*a* to second step 16 and at an upper end 30*b* to top step 18. The second link 32 is pivotally coupled at a lower end 32*a* to second step 16 and at an upper end 32*b* to top step 18 and arranged to lie in spaced-apart parallel relation to first link 30 as shown in FIG. 1. The steps 16, 18 and the links 30, 32 cooperate to form a foldable "parallelogram" linkage as shown in FIGS. 1 and 2. A third link 34 has one end 34*a* pivotally coupled to second step 16 and another end 34*b* pivotally coupled to one of the rear legs in rear U-tube 22. The fourth link 36 has a lower end 36*a* pivotally coupled to first step 14 and an upper end 36*b* pivotally coupled to second step 16 as shown in FIG. 1. As also shown in FIGS. 1, 3, and 4, one end 32*a*, 34*a*, 36*b* of each of links 32, 34, and 36 is coupled to second step 16 to pivot about a single horizontal axis 38 (phantom lines).

Figure 5:
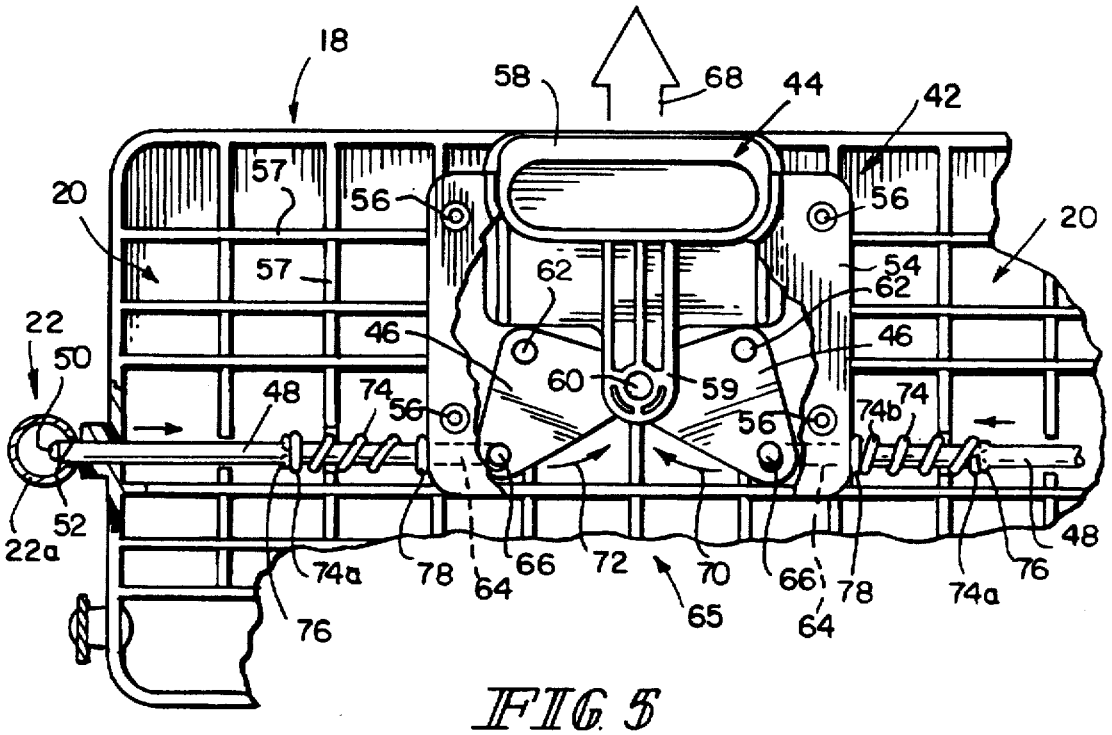
FIG. 5 is an underneath view of the movable step of the stool in its locked position taken along the line 5—5 of FIG. 4.
Figure 6:
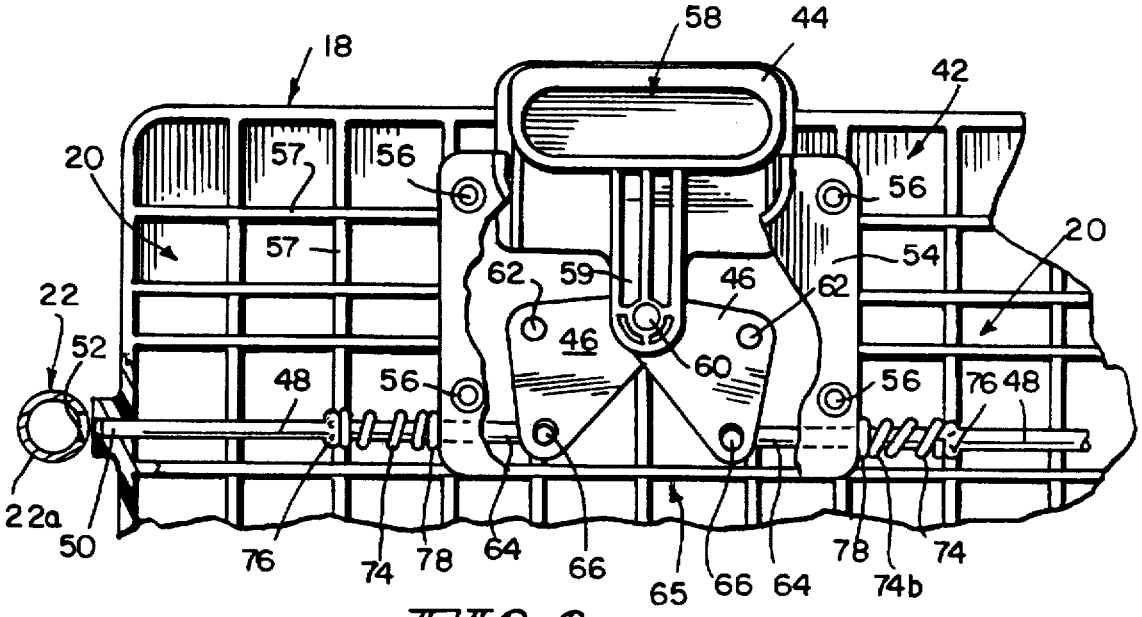
FIG. 6 is a view similar to FIG. 5 but with the step in its unlocked position.
Figure 7:
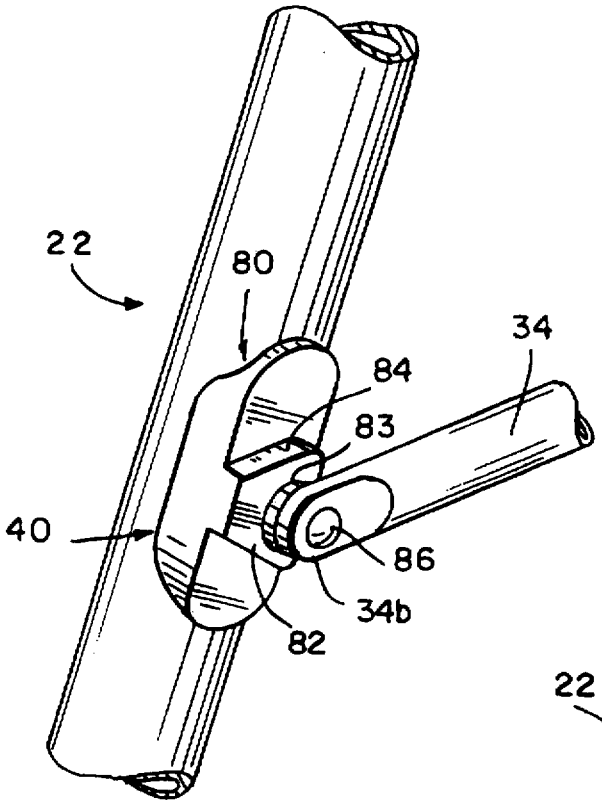
FIG. 7 is a perspective view of the mounting bracket for mounting the third supporting link to the rear leg, when the movable step is in its upper position.
Figure 8:
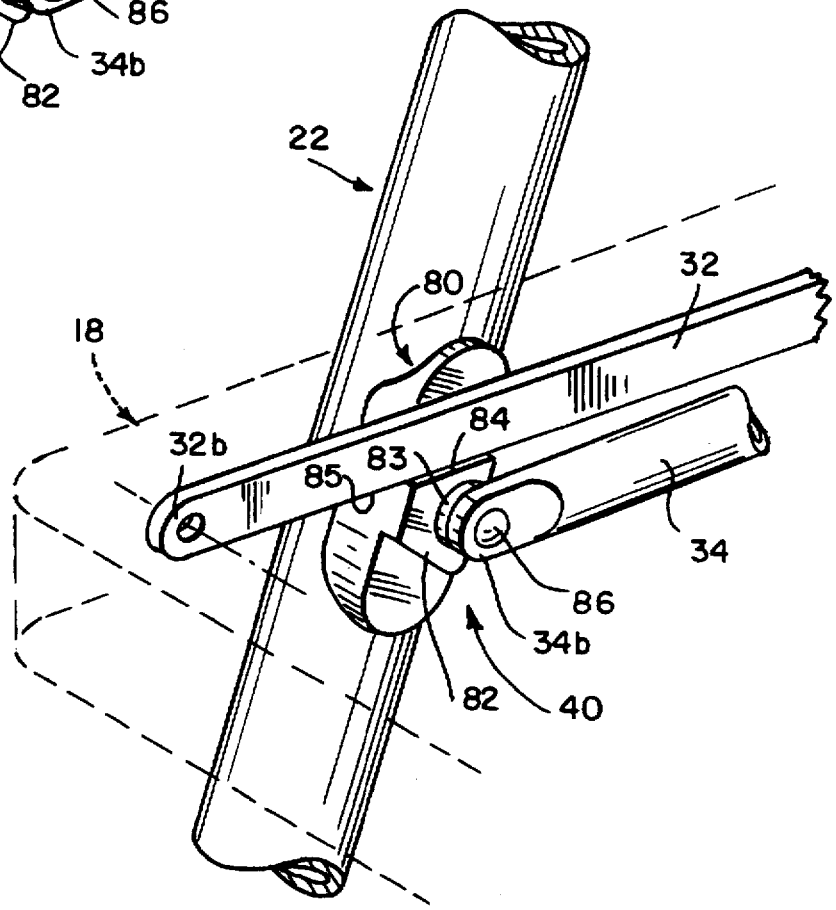
FIG. 8 is a similar view to FIG. 7 showing how the mounting bracket supports the second support link attached to the upper step when the movable step is in its lower aligned platform position.

In use, by operating the one-handed control linkage 42 shown in more detail in FIGS. 3–6, a user can elect to move top step 18 from its elevated position above underlying second step 16 as shown in FIG. 1 to its platform position alongside second step 16 as shown in FIG. 2. In this platform position, a bracket 40 of the type shown in FIGS. 7 and 8 is mounted to each of the rear legs 22*a,b* included in rear U-tube 22 to engage the second links 32 and support top step 18 in its platform position on frame 12.

Figure 3:
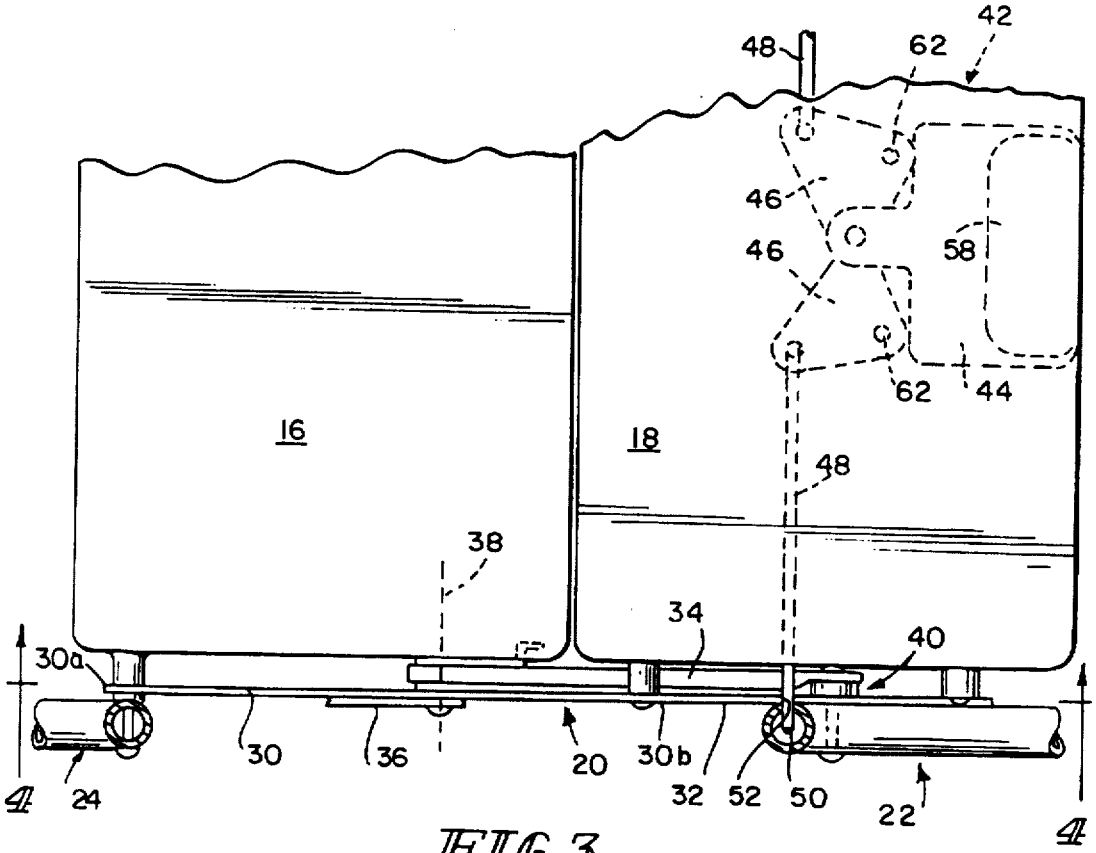
FIG. 3 is a partial plan view of the top step in its lower aligned platform position.

A partial top plan view of the large platform 16, 18 established by positioning top step 18 in a lowered position alongside second step 16 is shown in FIG. 3. The location of a portion of the one hand-operated release handle and mechanism assembly 42 is shown in dotted lines in its position underneath top step 18 in FIG. 3. This control assembly 42 includes a release handle 44, a pair of pivot members 46, and a pair of locking rods 48.

Figure 4:
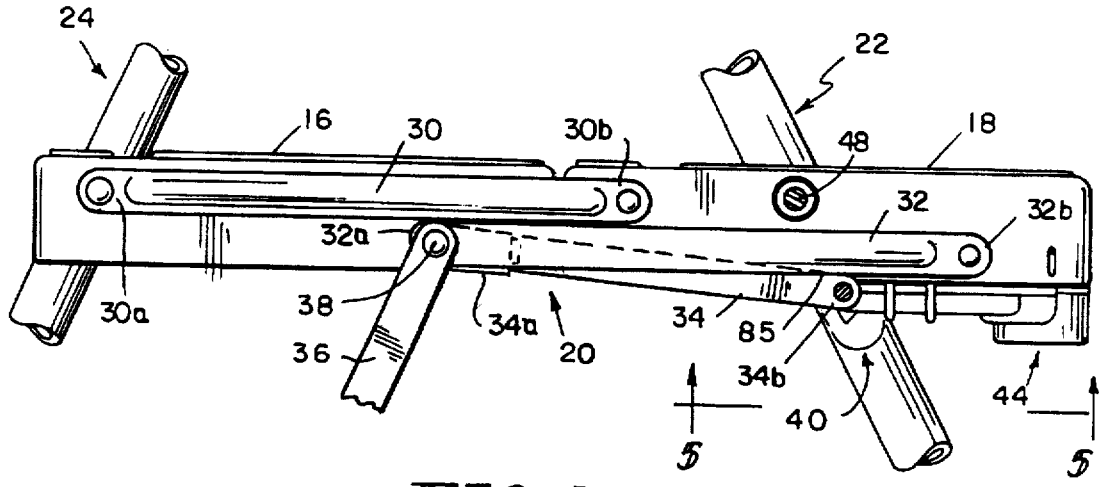
FIG. 4 is a side view of the stool taken along the line 4—4 of FIG. 3.

A partial side elevation of the two-step platform 16, 18 taken along line 4—4 of FIG. 3 is shown in FIG. 4. Control assembly 42 is shown in its normal locked position in FIGS. 3 and 4 wherein each of the locking rods 48 are biased outwardly (by spring assemblies such as those shown in FIGS. 5 and 6) to cause an outer end 50 of each locking rod 48 to pass through a hole 52 formed in one of the rear legs 22*a,b* of rear U-tube 22.

The normal position of control assembly 42 and its release handle 44 is shown in FIG. 5. This view is taken along lines 5—5 of FIG. 4. This view shows the locking assembly 42 when it is arranged in its normal locking configuration engaging the rear legs 22*a,b* of the rear U-tube 22. FIG. 5 also shows that control assembly 42 includes a mounting bracket 54 attached to top step 18 by bolt means 56 to support, guide, control, and govern reciprocating sliding movement of release handle 44 relative to top step 18. The bracket has a raised portion (not shown) which co-acts with the sides (not shown) of the handle 44 to guide the handle 44 in its reciprocating motion. Alternatively, the honeycomb reinforcement portions 57 on the bottom of the step 18 could be located such as to provide a guide for the handle 44. An outer end 58 of release handle 44 is formed to include a grip portion and an inner end 59 of release handle 44 is formed to include a pivot mount 60 for pivot members 46 as shown, for example, in FIGS. 5 and 6.

Each pivot member 46 is a plate having one portion pivotally coupled to top step 18 at pivot 62, another portion pivotally coupled to inner end 59 of release handle 44 at pivot 60, and still another portion pivotally coupled to an inner end 64 of locking rods 48 at pivot point 66. In the illustrated embodiment, each of pivot members 46 is a triangular flat plate arranged as shown in FIGS. 5 and 6 to resemble a flapping butterfly. When release handle 44 is pulled by a user relative to step 18 in the direction of double arrow 68, the pivot members 46 pivot about pivot points 62 in directions 70, 72 as shown in FIG. 5 to reach the positions shown in FIG. 6.

A spring 74 is provided for each of locking rods 48 to yieldably bias each locking spring rod 48 to its leg-engaging position as shown, for example, in FIG. 5. Spring 74 is a coiled compression spring having one end 74*a* urged against member 76 on locking rod 48 and another end 74*b* urged against a fixture 78 coupled to mounting bracket 54 or step 18.

In operation, to release top step 18 from movement relative to second step 16, grip handle 44 is moved in the direction of double arrow 68 to pivot the pivot members 46 about pivot points 62, thereby pulling inner ends 64 of locking rods 48 toward a middle portion 65 of top step 18 against biasing forces provided by springs 74 so that outer end 50 of each locking rod 48 is withdrawn from one of the holes 52 formed in the rear legs 22*a,b* of rear U-tube 22. The pivot members 46 thus provide for a force multiplication for ease in moving the handle 44. Using control assembly 42, both spring-loaded locking rods 48 are withdrawn simultaneously from engagement with the rear legs 22*a,b* in rear U-tube 22 so that top step 18 can be moved easily between its elevated position shown in FIG. 1 and its platform position shown in FIG. 2. If a force multiplication is not desired, the inner end 59 of the release handle 44 could be shaped as a V-shaped fork opening in which the pivots 66 rest. Movement of the handle 44 would thus cause the V-shape to cam the pivots 66 toward each other to withdraw the rods 48.

One of the two support brackets 40 for supporting top step 18 on frame 12 in the platform position of FIG. 2 is shown in FIGS. 7 and 8. Each support bracket 40 includes an outboard mounting portion 80 engaging one ofthe rear legs 22*a,b* of rear U-tube 22. Each support bracket 40 also includes an inboard support portion 82 appended to the outboard mounting portion 80 and arranged as shown, for example, in FIGS. 7 and 8 to provide an upwardly facing support surface 84 for engaging a downwardly facing edge 85 of link 32. A central aperture 83 is formed in support bracket 40 and this aperture 83 passes through mounting portion 80 and support portion 82 and receives a pivot pin 86 pivotally coupled to link 34 as shown in FIGS. 7 and 8. Preferably, each support bracket 40 is made of a plastics material. When top step 18 is pivoted downwardly to its platform position shown in FIG. 2, then the second pivot link 32 arranged on opposite sides of top step 18 comes to rest on the support surface 84 provided on each of the spaced-apart support brackets 40 mounted on the rear legs 22*a,b* of rear U-tube 22. This engagement is sufficient to carry the load of a person standing on the platform created by positioning top step 18 alongside second step 16 as shown in FIG. 2.

Figure 9:
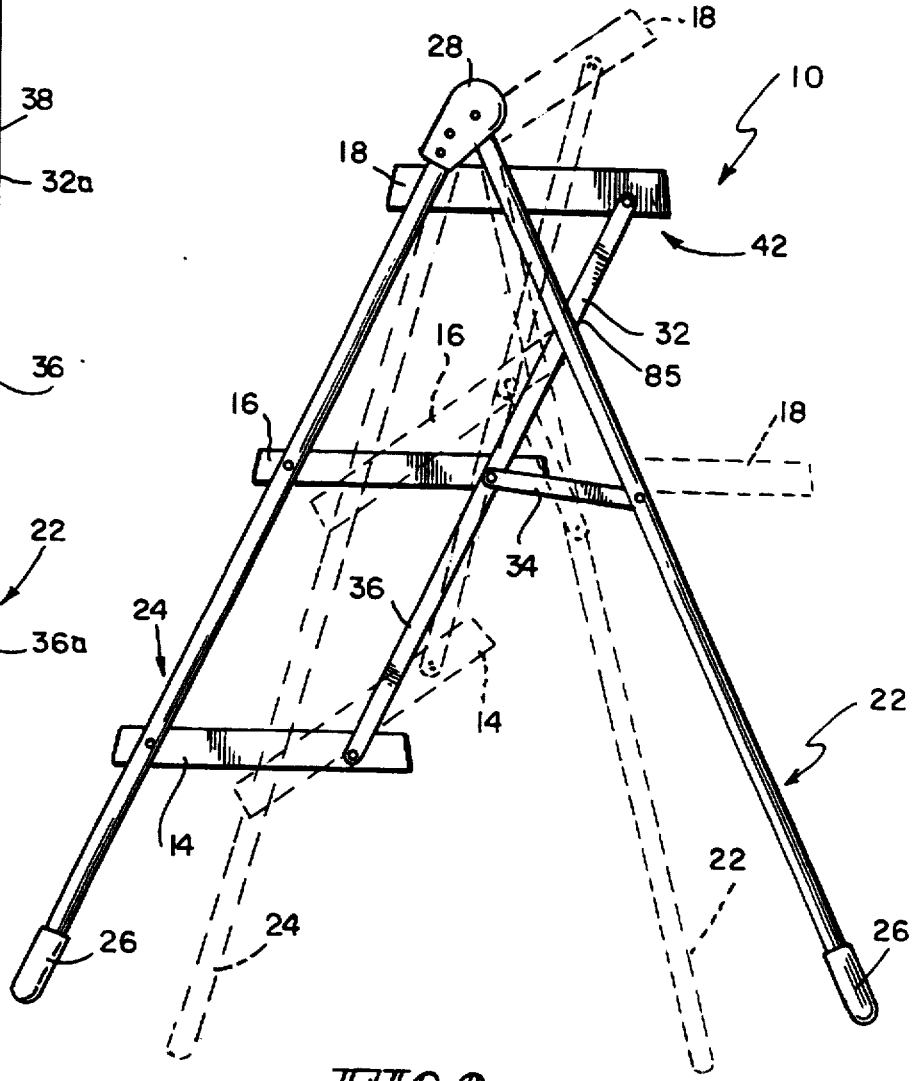
FIG. 9 is a side elevation view of the stool showing the orientation of the parts as it is collapsed from the position shown in FIG. 1 to a closed position.

FIG. 9 is a drawing illustrating a partial collapse of the platform stool 10. In order for the stool 10 to be collapsed for storage, the control assembly 42 must be moved to the position shown in FIG. 6 in which the top step 18 is unlocked from the rear legs 22*a,b* of the rear U-tube 22. Once the control assembly 42 is placed in its unlocked position and the top step 18 is moved to its elevated position above the second step 16, the stool 10 is collapsible from a fully extended position (solid lines) to an intermediate folding position (broken lines) as shown in FIG. 9. As the rear U-tube 22 and the front U-tube 24 are pivoted toward one another, the journaled elevated steps 14, 16, and 18 are pivoted to a flat-fold storage position. As shown in FIG. 9, the links 30, 32, 34, and 36 of the multi-part linkage 20 cooperate to keep the steps 14, 16, and 18 in a parallel relationship as the stool 10 is collapsed.

Figure 10:
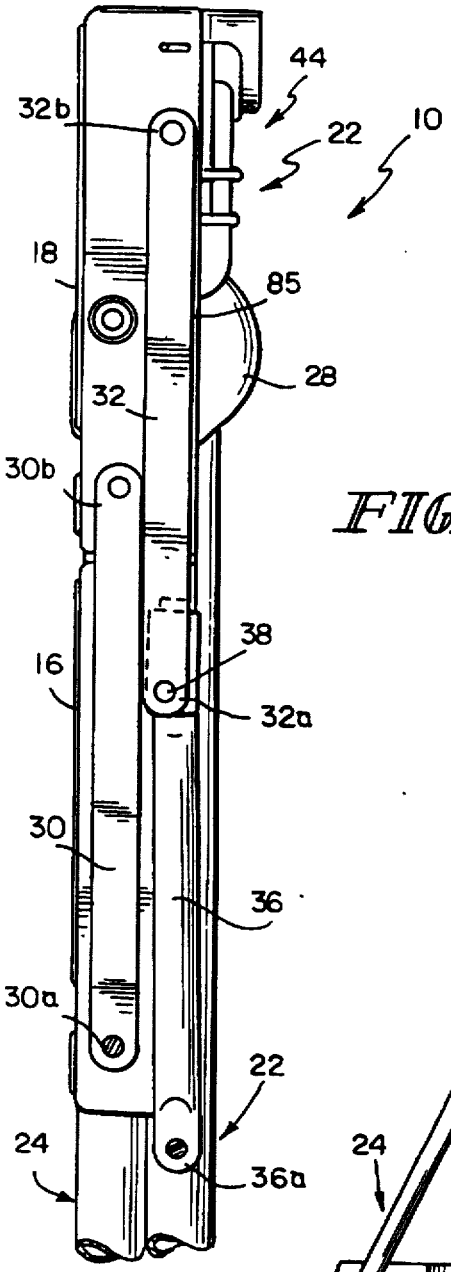
FIG. 10 is a side elevation view of the stool in its collapsed configuration.

FIG. 10 shows a portion of the platform stool 10 when it is in a fully collapsed position for flat fold storage. Although all of the illustrated steps 14, 16, and 18 are embraced between the folded rear U-tube 22 and front U-tube 24, the top step 18 partially extends above the apex of the stool 10. FIG. 10 shows that when the step stool is in its collapsed position, the first link 30, the second link 32, the fourth link 36, the rear legs 22*a,b* of the rear U-tube 22, and the front legs 24*a,b* of the front U-tube 24 are substantially parallel to each other. This collapsed configuration of the step stool 10 allows a user to easily carry the collapsed step stool 10 by grabbing the release handle 44 or top step 18 and vertically lifting the collapsed step stool 10. Once the collapsed step stool 10 is lifted, gravity acts to prevent the step stool 10 from opening. Alternatively, a user could carry the collapsed step stool 10 by simultaneously grabbing, with one hand, any adjacent portions of the rear U-tube 22 and the front U-tube 24. Grabbing the collapsed step stool 10 in this manner would constrain the step stool 10 in its collapsed position.

The control assembly 42 in accordance with the present invention cooperates to define locking means 44, 46, 48, 50, 52, 60, 62, 66 for locking a step 18 in a predetermined position relative to a step frame 12. The control assembly 42 includes a release handle 44, locking rods 48 coupled for movement relative to the step 18, spring means 74 for yieldably biasing each locking rod 48 from a leg-disengaging position to a leg-engaging position, and means 44, 46, 60, 62, 66 for moving the locking rods 48 simultaneously to their leg-disengaging positions in response to movement of the release handle 44 relative to the step 18 from a first to a second position. Once the locking rods 48 are moved to their leg-disengaging positions, a multi-part linkage 20 engaging frame 12 and steps 14, 16, 18 is used to move a top step 18 relative to frame 12 from an elevated position above underlying step 16 to a platform position alongside step 16 and also to facilitate unfolding of the step stool 10 to an opened use position and folding of the step stool 10 to a closed collapsed storage position.

Although the invention has been described in detail with reference to certain preferred embodiments, variations and modifications exist within the scope and spirit of the invention as described and defined in the following claims.

I claim:

1. A platform stool comprising a frame including a first leg and a second leg coupled to the first leg for pivoting movement about a leg pivot axis, a plurality of steps mounted on the frame one above another, the steps including at least an upper step and a lower step, the upper step having a first position about the lower step and a second position alongside the lower step to form a platform therewith, a linkage coupled to the upper step and coupled to the frame, the linkage controlling movement of the upper step between the first position and the second position, a pair of locking rods for releasably locking the upper step in one of its first and second positions, the locking rods being mounted to the upper step for movement between a locking position wherein the locking rods retractably engaged the frame to lock the upper step to the frame and a releasing position wherein the locking rods are disengaged from the frame so that the upper step can move between the first and second positions, the locking rods moving in a direction substantially parallel with the leg pivot axis during movement between the locking and releasing positions, and an actuator mounted to the upper step, the actuator including a release handle and a member coupling the release handle to the pair of locking rods.

2. The stool of claim 1, wherein the locking rods and actuator are mounted to the upper step underneath an upper surface of the upper step.

3. The stool of claim 1, wherein the release handle is guided to reciprocally move in a plane substantially parallel to an upper surface of the upper step so that movement of the release handle in one direction moves the locking rods to the locking position and movement of the release handle in an opposite direction moves the locking rods to the releasing position.

4. The stool of claim 1, wherein the release handle is centrally mounted for one-hand operation adjacent to a rear edge of the upper step.

5. The stool of claim 1, wherein the frame is formed to include a pair of upper apertures and a pair of lower apertures, the locking rods are received in respective upper apertures to lock the upper step in the first position above the lower step, and the locking rods are received in respective lower apertures to lock the upper step in the second position alongside the lower step to form a platform therewith.

6. The stool of claim 1, wherein the locking rods are guided to move reciprocally in a plane substantially parallel with an upper surface of the upper step during movement of the locking rods between the locking and releasing positions.

7. The stool of claim 1, wherein each of the locking rods is spring-biased toward the locking position.

8. A platform stool comprising a frame, a plurality of steps mounted on the frame one above another, the steps including at least an upper step and a lower step, the upper step having a first position above the lower step and a second position alongside the lower step to form a platform therewith, means for mounting the upper step on the frame for movement between the first position and the second position, a pair of locking rods for releasably locking the upper step in one of its first and second positions, the locking rods being mounted to the upper step for movement between a locking position wherein the locking rods retractably engage the frame to lock the upper step to the frame and a releasing position wherein the locking rods are disengaged from the frame so that the upper step can move between the first and second positions, and an actuator mounted to the upper step, the actuator including a release handle and linkage means for coupling the release handle to the pair of locking rods, the linkage means including a pivot member pivotably coupled to the release handle and pivotably coupled to the locking rods.

9. The stool of claim 8, wherein the pivot member is pivotably coupled to the upper step.

10. A platform stool comprising a frame, a plurality of steps mounted on the frame one above another, the steps including at least an upper step and a lower step, the upper step having a first position above the lower step and a second position alongside the lower step to form a platform therewith.

means for mounting the upper step on the frame for movement between the first position and the second position, a pair of locking rods for releasably locking the upper step in one of its first and second positions, the locking rods being mounted to the upper step for movement between a locking position wherein the locking rods retractably engage the frame to lock the upper step to the frame and a releasing position wherein the locking rods are disengaged from the frame so that the upper step can move between the first and second positions, and an actuator mounted to the upper step, the actuator including a release handle and linkage means for coupling the release handle to the pair of locking rods, each locking rod of the pair of locking rods opposing one another and being guided to move along a common axis when the release handle is actuated.

11. A platform stool comprising a frame, a plurality of steps mounted on the frame one above another, the steps including at least an upper step and a lower step, the upper step having a first position above the lower step and a second position alongside the lower step to form a platform therewith, a linkage mounting the upper step on the frame for movement between the first position and the second position, the linkage including a link having a lower end coupled to the lower step for pivoting movement about a first pivot axis and an upper end coupled to the upper step for pivoting movement about a second pivot axis, and a support bracket coupled to the frame and including a support surface that engages the link between the first pivot axis and the second pivot axis to reinforceably support the linkage when the upper step is in the second position alongside the lower elevated step to form a platform therewith.

12. The stool of claim 11, wherein the support surface of the support bracket is positioned to lie between the upper step and the frame when the upper step is in the second position alongside the lower step to form a platform therewith.

13. A platform stool comprising a pair of separated from assembles each having a first and second leg, at least one first step extending between the frame assembles at a first height secured to said first legs, at least one second step pivotally linked to the first step and extending between the frame assembles at a second height above said first height of said first step and movable to a position where the second step is at the same height as the first step, movable latch means located on said second step for securing and second step to said frame assemblies at both height positions, the latch means comprising plural movable locking rods which can be extended into one of two ports on each of the second legs, dependent on whether the second step is locked at a position at the second or first height respectively, each of the ports in one of the second legs having an inlet opening for one of the locking rods, which inlet openings are in alignment with and face inlet rod openings of the ports on the other of the second legs, and a handle attached to the second step and to both of the locking rods for withdrawing both of the rods when extended into respective ports to a position outside of the ports to permit adjustment of the second step to the desired height.

14. The platform stool of claim 13, wherein the plural rods are spring biased in a direction orthogonally away from the second step toward entry into the inlet open of the respective port.

15. The platform stool of claim 14, wherein the locking rods each extend outwardly through an aperture located in the side walls of the second step.

16. The platform stool of claim 15, wherein the handle is constrained to reciprocate in a direction orthogonal to the direction of movement of the locking rods.

17. The platform stool of claim 16, wherein one end of each of the locking rods is attached to a respective pivoting member through a rotatable joint, and wherein the handle is movable to pivot both pivoting members.

18. The platform stool of claim 16, wherein the second step is provided with guides to provide the constraint for the handle movement.

19. The platform stool of claim 13, wherein the handle is constrained to reciprocate in a direction orthogonal to the direction of movement of the locking rods.

20. The platform stool of claim 19, wherein the second step is provided with guides to provide the constraint for the handle movement.

21. The platform stool of claim 20, wherein the guides are molded into the second step.

22. The platform stool of claim 19, wherein one end of each of the locking rods is attached to a respective pivoting member through a rotatable joint, and wherein the handle is movable to pivot both pivoting members.

23. The platform stool of claim 13, wherein the locking rods each extend outwardly through an aperture located in the side walls of the second step.

24. A platform stool comprising a frame, a plurality of steps mounted on the frame one above another, the steps including at least an upper step and a lower step, the upper step having a first position above the lower step and a second position alongside the lower step to form a platform therewith, a linkage mounting the upper step on the frame for movement between the first position and the second position, a pair of locking rods for releasably locking the upper step in one of its first and second positions, the locking rods being mounted to the upper step for movement between a locking position wherein the locking rods retractably engage the frame to lock the upper step to the frame and a releasing position wherein the locking rods are disengaged from the frame so that the upper step can move between the first and second positions, and an actuator mounted to the upper step, the actuator including a release handle and a release linkage coupling the release handle to the pair of locking rods, the release linkage including a pivot member pivotably coupled to the release handle and pivotably coupled to the locking rods.

25. The stool of claim 24, wherein the pivot member is pivotably coupled to the upper step.

26. A platform stool comprising a frame, a plurality of steps mounted on the frame one above another, the steps including at least an upper step and a lower step, the upper step having a first position above the lower step and a second position alongside the lower step to form a platform therewith, a linkage mounting the upper step on the frame for movement between the first position and the second position, a pair of locking rods for releasably locking the upper step in one of its first and second positions, the locking rods being mounted to the upper step for movement between a locking position wherein the locking rods retractably engage the frame to lock the upper step to the frame and a releasing position wherein the locking rods are disengaged from the frame so that the upper step can move between the first and second positions, and an actuator mounted to the upper step, the actuator including a release handle and a release linkage coupling the release handle to the pair of locking rods, each locking rod of the pair of locking rods opposing one another and being guided to move along a common axis when the release handle is actuated.

27. A platform stool comprising a pair of separated frame assemblies each having a first and second leg, at least one first step extending between the frame assembles at a first height secured to said first legs, at least one second step pivotally linked to the first step and extending between the frame assembles at a second height above said first height of said first step and movable to a position where the second step is at the same height as the first step, a movable latch located on said second step and configured to secure said second step to said frame assemblies at both height positions, the latch comprising plural movable locking rods which can be extended into one of two ports on each of the second legs, dependent on whether the second step is locked at a position at the second or first height respectively, each of the ports in one of the second legs having an inlet opening for one of the locking rods, which inlet openings are in alignment with and face inlet rod openings of the ports on the other of the second legs, and a handle attached to the second step and to both of the locking rods for withdrawing both of the rods when extended into respective ports to a position outside of the ports to permit adjustment of the second step to the desired height.

* * * * *